US011419381B2

(12) United States Patent
Torres

(10) Patent No.: US 11,419,381 B2
(45) Date of Patent: Aug. 23, 2022

(54) CRANIAL PROTECTION CELL

(71) Applicant: Maurício Paranhos Torres, Campinas (BR)

(72) Inventor: Maurício Paranhos Torres, Campinas (BR)

( * ) Notice: Subject to any disclaimer, the term of this patent is extended or adjusted under 35 U.S.C. 154(b) by 0 days.

(21) Appl. No.: 15/574,672

(22) PCT Filed: Apr. 29, 2016

(86) PCT No.: PCT/BR2016/050095
§ 371 (c)(1),
(2) Date: Nov. 16, 2017

(87) PCT Pub. No.: WO2016/183652
PCT Pub. Date: Nov. 24, 2016

(65) Prior Publication Data

US 2018/0132557 A1 May 17, 2018

(30) Foreign Application Priority Data

May 19, 2015 (BR) ..... 10 2015 011 545-8
Apr. 12, 2016 (BR) ..... 10 2016 008 113-0

(51) Int. Cl.
*A42B 3/22* (2006.01)
*A42B 3/12* (2006.01)
(Continued)

(52) U.S. Cl.
CPC ..... *A42B 3/222* (2013.01); *A42B 3/063* (2013.01); *A42B 3/128* (2013.01); *A42B 3/205* (2013.01);
(Continued)

(58) Field of Classification Search
CPC ..... A42B 3/222; A42B 3/063; A42B 3/128; A42B 3/205; A42B 3/223; A42B 3/326;
(Continued)

(56) References Cited

U.S. PATENT DOCUMENTS 2,867,811 A * 1/1959 Jones ..... A42B 3/08 2/421
2,908,911 A * 10/1959 Sowle ..... A42B 3/20 2/9

(Continued)

FOREIGN PATENT DOCUMENTS

EP 1183956 A2 3/2002
WO WO 2005/000059 A1 1/2005

OTHER PUBLICATIONS

WIPO, Search Report, PCT Publication WO 2016/183652, dated Nov. 24, 2016.

(Continued)

*Primary Examiner* — Khaled Annis
*Assistant Examiner* — Dakota Marin
(74) *Attorney, Agent, or Firm* — Leydig, Voit & Mayer, Ltd.

(57) ABSTRACT

IMPROVEMENTS INTRODUCED IN A CRANIAL PROTECTION CELL, formed by an outer shell (11, 20) internally coated by absorbent material (12, 12'), said material comprising a first layer (21) immediately below the shell, of closed cell foam, rigid or semi-rigid in contact with a second layer (22) of open cell viscoelastic foam, the interface between said first and second layers being provided with interdigitations comprising cavities (24) in said first layer in which protrusions (23), provided in said second layer, fit in a complementary and cooperative manner. Absorbent supporting material are further provided in the jaw region (32), maxillary regions (33, 34) and mastoid regions. When closed, the visor (37) is embedded in the corresponding opening of the cranial protection cell, and its opening occurs in two steps, the former comprising forward movement, and the latter upward rotation. The cranial protection cell (CPC) further comprises a removable chin guard (54) whose
(Continued)

unlocking mechanism is driven by buttons (51) located on either side of the shell.

11 Claims, 7 Drawing Sheets

(51) Int. Cl.
*A42B 3/32* (2006.01)
*A42B 3/06* (2006.01)
*A42B 3/20* (2006.01)

(52) U.S. Cl.
CPC ..... *A42B 3/223* (2013.01); *A42B 3/326* (2013.01); *A42B 3/064* (2013.01); *A42B 3/12* (2013.01); *A42B 3/121* (2013.01); *A42B 3/122* (2013.01); *A42B 3/124* (2013.01); *A42B 3/125* (2013.01); *A42B 3/127* (2013.01)

(58) Field of Classification Search
CPC ..... A42B 3/12; A42B 3/121; A42B 3/122; A42B 3/124; A42B 3/125; A42B 3/127; A42B 3/064
USPC ..... 2/412
See application file for complete search history.

(56) References Cited

U.S. PATENT DOCUMENTS 3,132,345 A * 5/1964 Keith ..... A42B 3/20 2/9
3,187,342 A * 6/1965 Aileo ..... A42B 3/08 2/421
3,216,023 A * 11/1965 Morgan ..... A42B 3/08 128/857
3,495,273 A * 2/1970 Aileo ..... A42B 3/228 2/6.4
3,500,473 A * 3/1970 Marchello ..... A42B 3/065 2/414
3,585,638 A * 6/1971 Aileo ..... A42B 3/228 2/410
3,720,955 A * 3/1973 Rawlings ..... A42B 3/127 2/415
3,723,992 A * 4/1973 Kamata ..... A42B 3/06 2/415
3,729,744 A * 5/1973 Rappleyea ..... A42B 3/127 2/420
3,843,970 A * 10/1974 Marietta ..... A42B 3/127 2/415
3,934,271 A * 1/1976 Rhee ..... A42B 3/18 2/424
3,946,441 A 3/1976 Johnson
4,023,213 A 5/1977 Rovani
4,242,757 A * 1/1981 Nava ..... A42B 3/222 2/10
4,259,747 A * 4/1981 Taesler ..... A42B 3/145 2/422
4,307,471 A 12/1981 Lovell
4,312,078 A * 1/1982 Pollitt ..... A42B 3/222 16/348
4,483,021 A 11/1984 McCall
4,524,465 A 6/1985 Huber
4,534,068 A 8/1985 Mitchell et al.
4,553,270 A * 11/1985 Hoffmann ..... A42B 3/24 2/421
4,621,377 A * 11/1986 Pennell ..... A42B 3/228 2/10
4,627,115 A 12/1986 Broersma
4,641,382 A * 2/1987 Gessalin ..... A42B 3/326 2/414
4,665,569 A 5/1987 Santini
4,689,836 A * 9/1987 Vitaloni ..... A42B 3/326 2/411
4,706,305 A * 11/1987 Cho ..... A42B 3/00 2/417
4,764,990 A 8/1988 Markert
4,769,857 A * 9/1988 Cianfanelli ..... A42B 3/326 2/421
4,907,299 A * 3/1990 Arai ..... A42B 3/222 2/424
4,916,759 A * 4/1990 Arai ..... A42B 3/127 2/414
5,003,631 A * 4/1991 Richardson ..... A42B 3/166 2/413
5,056,162 A 10/1991 Tirums
5,090,061 A * 2/1992 Kamata ..... A42B 3/16 2/423
5,185,889 A * 2/1993 Kamata ..... A42B 3/222 2/424
5,203,034 A * 4/1993 Foehl ..... A42B 3/08 2/421
5,315,718 A 5/1994 Barson et al.
5,329,642 A * 7/1994 Dampney ..... A42B 3/222 2/424
5,444,875 A * 8/1995 Taniuchi ..... A42B 3/326 2/424
5,687,426 A 11/1997 Sperber
5,713,082 A 2/1998 Bassette et al.
5,745,923 A 5/1998 Katz
5,794,274 A * 8/1998 Kraemer ..... A42B 3/205 2/421
5,950,244 A * 9/1999 Fournier ..... A42B 3/128 2/411
6,047,409 A * 4/2000 Simpson ..... A42B 3/223 2/424
6,081,932 A * 7/2000 Kraemer ..... A42B 3/08 2/421
6,226,803 B1 5/2001 Tanaka
6,282,724 B1 9/2001 Abraham et al.
6,282,726 B1 9/2001 Neyerie et al.
6,339,849 B1 1/2002 Nelson et al.
6,360,376 B1 3/2002 Carrington
6,434,755 B1 * 8/2002 Halstead ..... A42B 3/06 2/413
6,446,271 B1 * 9/2002 Ho ..... A42B 3/12 2/414
6,453,476 B1 * 9/2002 Moore, III ..... A42B 3/125 2/412
6,598,238 B2 * 7/2003 Hong ..... A42B 3/326 2/424
6,711,753 B2 * 3/2004 Arai ..... A42B 3/222 2/424
6,925,657 B2 * 8/2005 Takahashi ..... A42B 3/128 2/412
6,931,670 B2 * 8/2005 Arai ..... A42B 3/222 2/424
7,062,795 B2 * 6/2006 Skiba ..... A42B 3/063 156/212
7,065,798 B2 * 6/2006 Kuo ..... A42B 3/222 2/424
7,207,072 B2 * 4/2007 Halsnes ..... A42B 3/222 2/424
7,398,561 B2 * 7/2008 Kim ..... A42B 3/326 2/424
7,802,320 B2 * 9/2010 Morgan ..... A42B 3/128 2/411
7,814,579 B2 * 10/2010 Dion ..... A42B 3/326 2/410
7,832,023 B2 * 11/2010 Crisco ..... A42B 3/20 2/410
8,051,499 B2 * 11/2011 Lee ..... A42B 3/222 2/10
8,082,600 B2 * 12/2011 Morin ..... A42B 3/326 2/15
8,555,424 B2 * 10/2013 Higgins ..... A42B 3/223 2/15
8,578,520 B2 * 11/2013 Halldin ..... A42B 3/066 2/411

(56) References Cited

U.S. PATENT DOCUMENTS 8,918,912 B2 * 12/2014 Cho ..... A42B 3/223 2/15
8,955,169 B2 * 2/2015 Weber ..... A42B 3/125 2/411
9,210,961 B2 12/2015 Torres
2001/0032351 A1 * 10/2001 Nakayama ..... A42B 3/064 2/412
2003/0051289 A1 * 3/2003 Gafforio ..... A42B 3/222 2/424
2003/0140400 A1 * 7/2003 Ho ..... A42B 3/063 2/411
2003/0229934 A1 * 12/2003 Gafforio ..... A42B 3/222 2/424
2004/0019958 A1 * 2/2004 Arai ..... A42B 3/223 2/424
2004/0025231 A1 * 2/2004 Ide ..... A42B 3/08 2/425
2005/0196592 A1 * 9/2005 Tao ..... A42B 3/124 428/180
2005/0246824 A1 * 11/2005 Berger ..... A42B 3/124 2/412
2006/0059606 A1 3/2006 Ferrara
2006/0070170 A1 * 4/2006 Copeland ..... A42B 3/124 2/411
2006/0070171 A1 * 4/2006 Copeland ..... A42B 3/124 2/455
2006/0112477 A1 * 6/2006 Schneider ..... A42B 3/063 2/412
2008/0009556 A1 * 1/2008 Schneider ..... C08G 18/10 521/128
2008/0028501 A1 * 2/2008 Schimpf ..... A42B 3/224 2/424
2010/0000009 A1 * 1/2010 Morgan ..... F41H 1/08 2/414
2010/0299812 A1 * 12/2010 Maddux ..... A41D 13/0156 2/414
2011/0107503 A1 * 5/2011 Morgan ..... A42B 3/124 2/456
2011/0154551 A1 * 6/2011 Spink ..... A42B 3/223 2/10
2012/0060251 A1 3/2012 Schimpf
2012/0198604 A1 8/2012 Weber et al.
2013/0025015 A1 * 1/2013 Isobe ..... A42B 3/226 2/10
2013/0312165 A1 * 11/2013 Hardy ..... A42B 3/20 2/424
2013/0340147 A1 * 12/2013 Giles ..... A42B 3/00 2/412
2014/0075654 A1 * 3/2014 McGinn ..... A42B 3/18 2/422
2014/0223641 A1 * 8/2014 Henderson ..... A42B 3/127 2/411
2014/0352020 A1 * 12/2014 Isobe ..... A42B 3/223 2/9
2015/0059069 A1 * 3/2015 Arai ..... A42B 3/222 2/424
2015/0089722 A1 * 4/2015 Berry ..... A42B 3/064 2/412
2015/0157083 A1 * 6/2015 Lowe ..... A42B 3/064 2/412
2015/0230535 A1 * 8/2015 McGuckin, Jr. ..... A42B 3/122 2/413
2015/0305427 A1 * 10/2015 Prabhu ..... A42B 3/128 2/412
2015/0305430 A1 * 10/2015 Rush ..... A42B 3/128 2/412

OTHER PUBLICATIONS

Aare et al., "A New Laboratory Rig for Evaluating Helmets Subject to Oblique Impacts," *Traffic Injury Prevention*, 4(3): 240-248 (2003).
MIPS AB, "Helmets for Safety: Science and Technology," Webpage downloaded from the Internet at https://mipsprotection.com/science-technology/ on May 21, 2021, 11 pp.

* cited by examiner

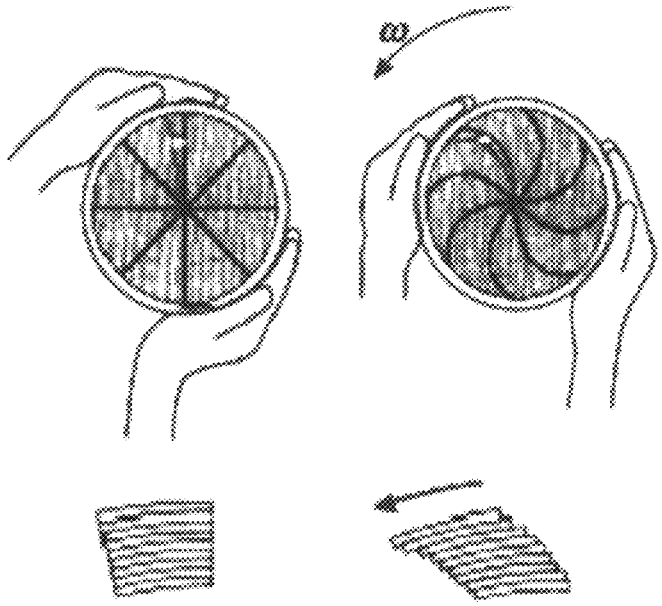
Fig. 1
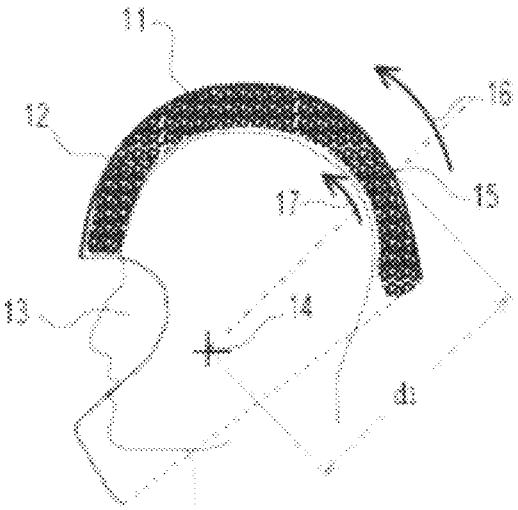
Fig. 2-a
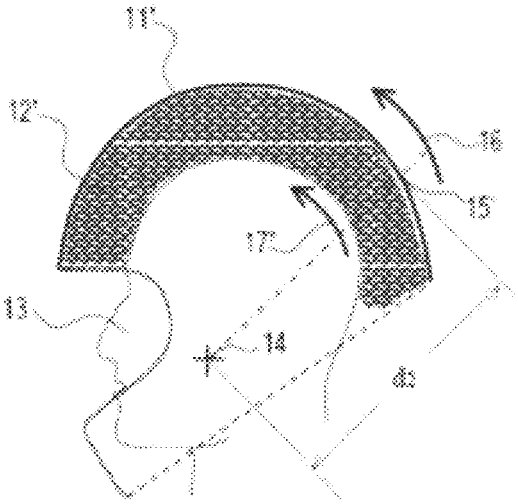
Fig. 2-b

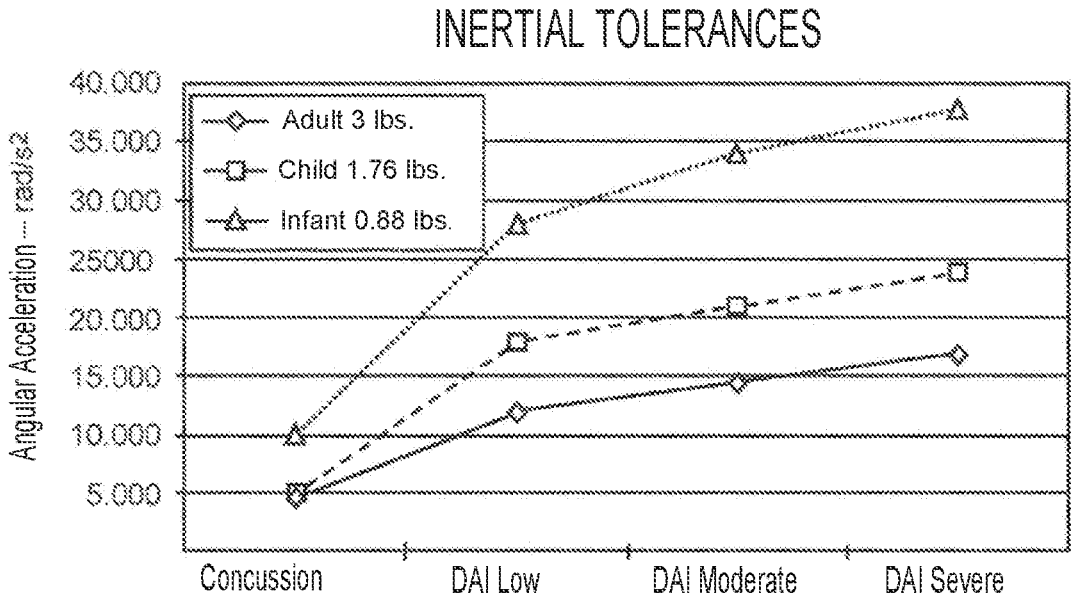
*Fig. 5*
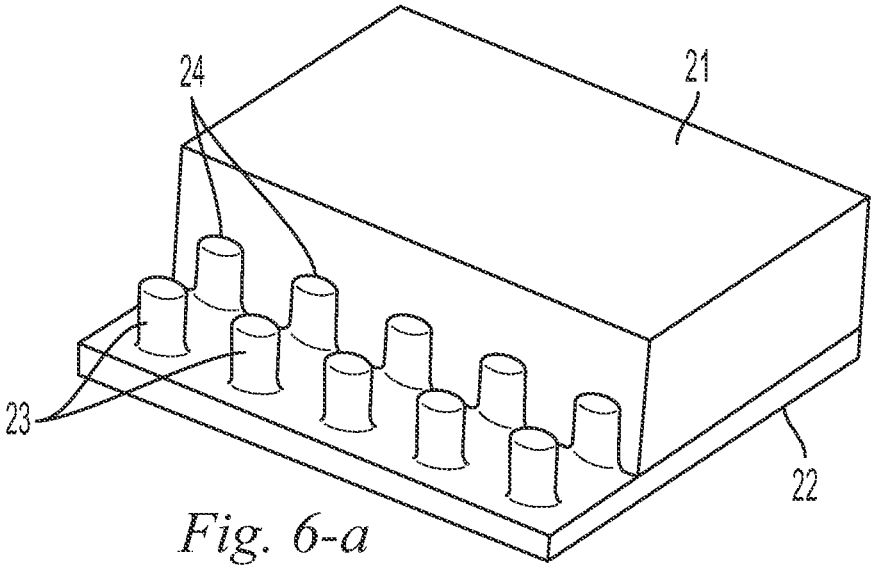
*Fig. 6-a*
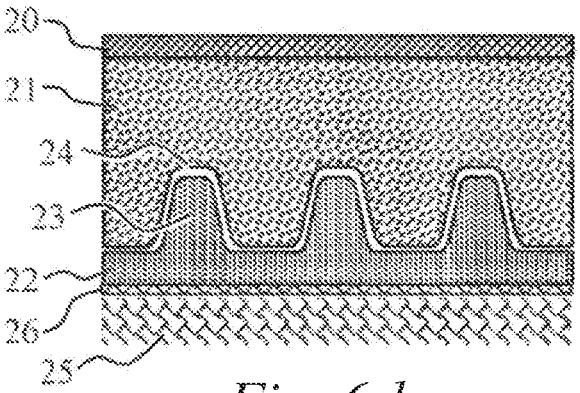
*Fig. 6-b*
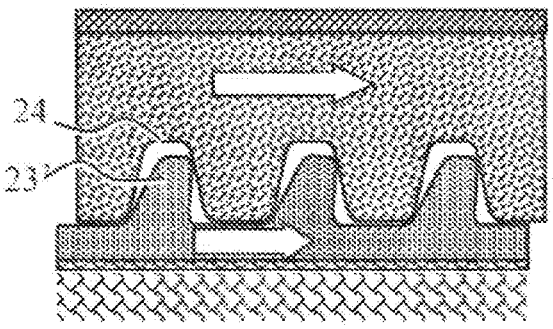
*Fig. 6-c*

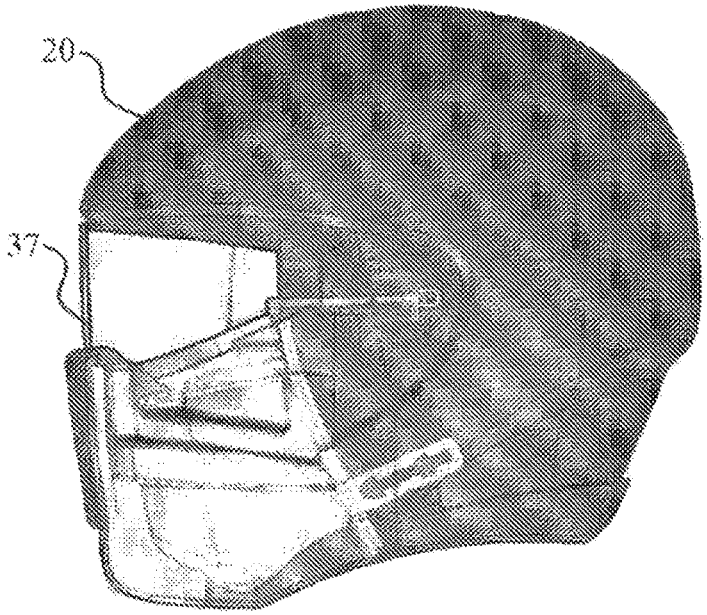
Fig. 9-a
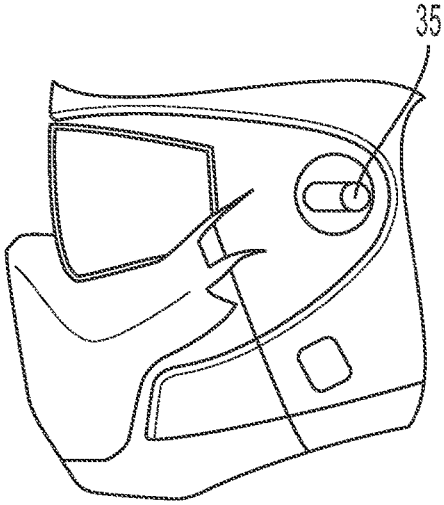
Fig. 9-b
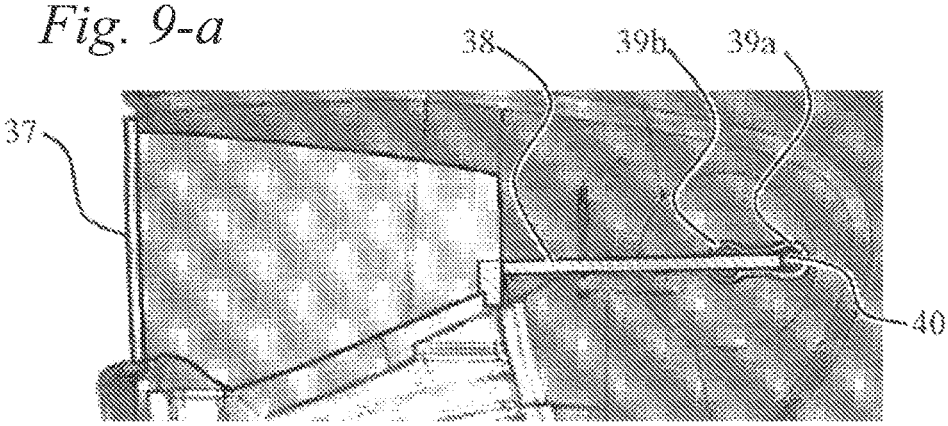
Fig. 9-c
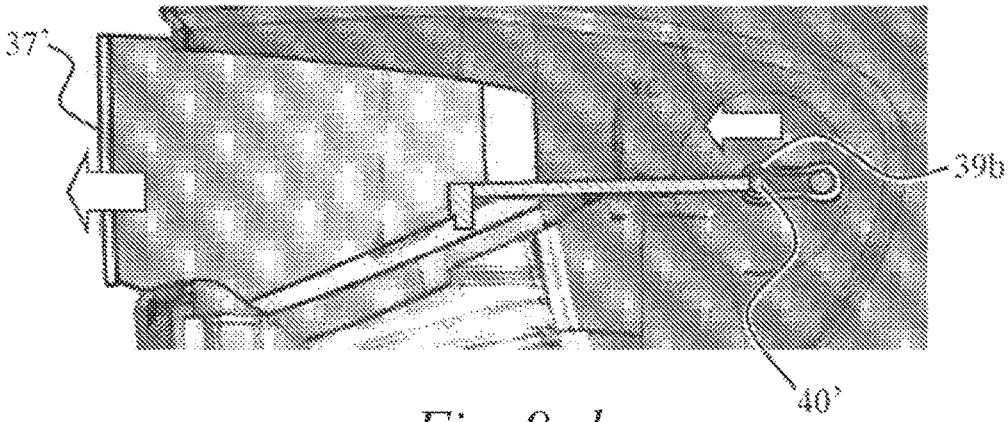
Fig. 9-d

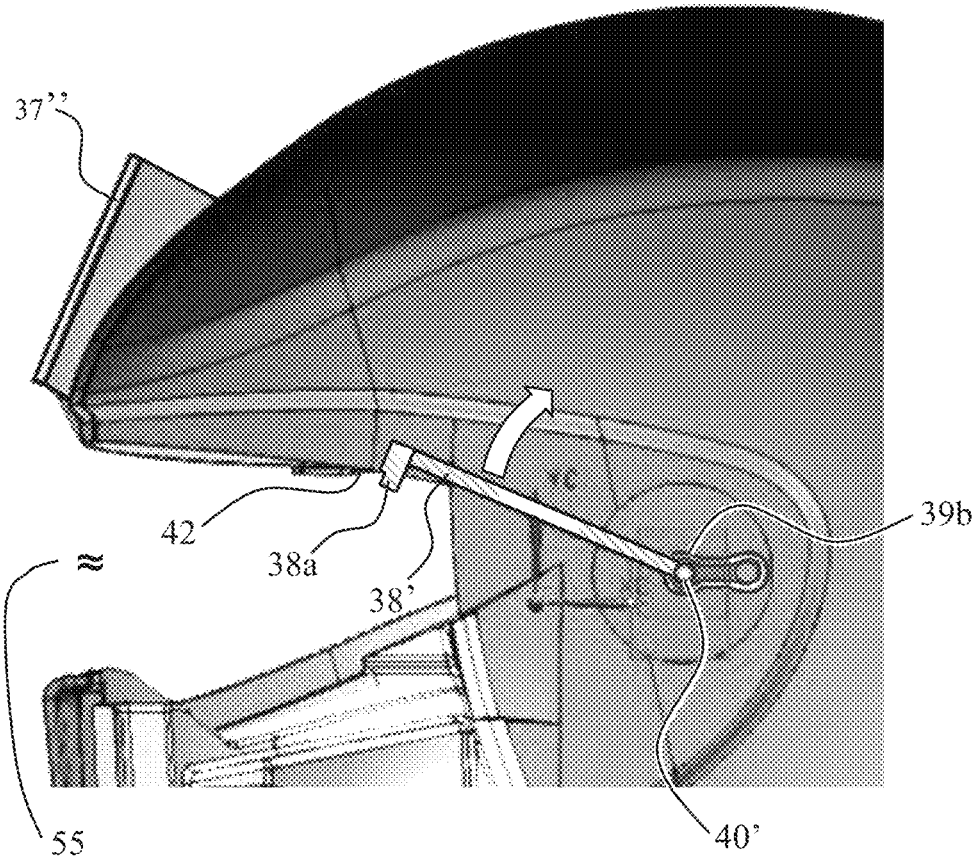
*Fig. 9-e*

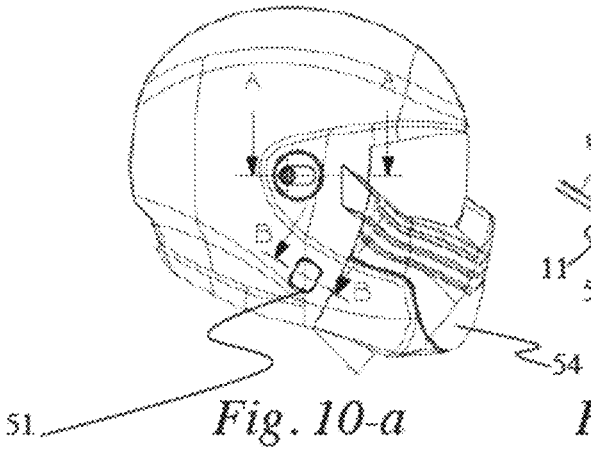
Fig. 10-a
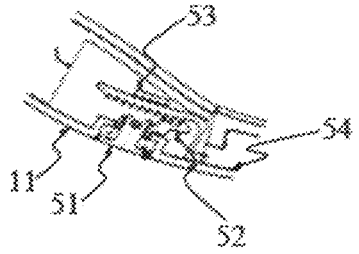
Fig. 10-b
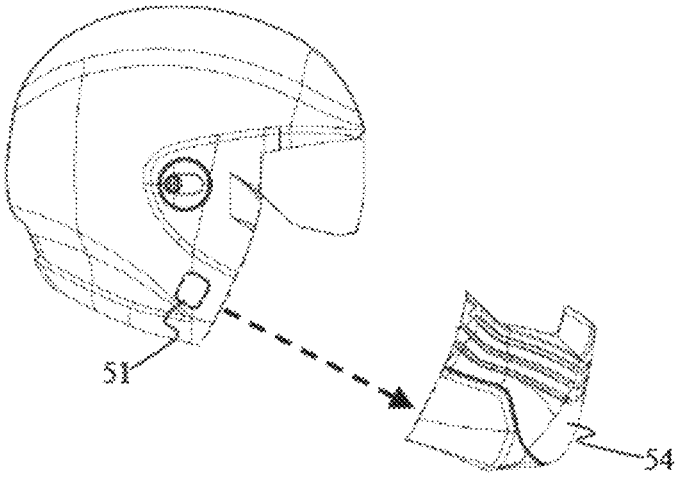
Fig. 10-c

CRANIAL PROTECTION CELL

CROSS REFERENCE TO RELATED APPLICATION

This application claims priority to PCT Patent Application No. PCT/BR2016/050095, filed on Apr. 29, 2016, which claims priority to Brazil Patent Application No. BR10201511545-8, filed on May 19, Brazil Patent Application No. BR10201511545-8, filed on May 19, 2015 and Brazil Patent Application No. BR102016008113-0, filed on April 12, Brazil Patent Application No. BR102016008113-0, filed on Apr. 12, 2016.

FIELD OF APPLICATION

In general, the present invention relates to improvements in articles intended for individual head protection against impacts and decelerations. More particularly, these articles are intended to protect motorcyclists' heads, but their application may be extended to other activities such as motor racing, cycling, construction, and other situations where it is necessary to protect the brain against injuries. Although the word "helmet" is commonly used to designate such articles produced according to the state of the art, the term Cranial Protection Cell, or CPC, will be adopted in the present description to denote the subject matter of the invention proposed herein, since its characteristics, performance and functionalities surpass what exists today.

STATE OF THE ART

The initial considerations set out below are intended to clarify the nature of the problem which the invention is intended to solve in order to make the advantages of the invention more evident.

The helmets—from the Latin caput (head)—arose historically from the need to protect against direct impacts of arrows, spears, swords and, in modern times, against projectiles. Its main function was to protect the skull, and consequently the brain, against direct impact injuries.

From the invention of the motorcycle in 1885 by Gottlieb Daimler and the consequent expansion of motor sports, the need for protection against head injuries due to falls and accidents has increased. The speed and, thus, the acceleration exceeded the natural limits of protection that the individual's skull provides to the brain.

It is worth mentioning that the object of protection is the brain of the individual. Nature had millions of years to create an adequate casing for this task, the skull, but it has limits, surpassed by the speed, acceleration and the forces encountered today.

The inventor, who is a neurosurgeon, explains that brain injuries due to trauma are classified according to the predominant type of force: concussion, diffuse axonal injury (DAI), subdural hematoma, contusion and intra-cerebral hematoma, in the case of predominance of rotational forces; fracture of the skull, epidural hematoma and cerebral contusion due to fracture in case of predominance of radial forces.

As the current helmets are based on the patent of Roth et al. dated 1947 (U.S. Pat. No. 2,625,683) do not work in the prevention of deceleration injuries, since the physiopathology of these was only studied in detail by Thomas Gennarelli in the late 1980s. This kind of injury is known today to be the cause of death and severe sequelae in motorcycle accidents as well as in those involving speed, as the ski accident the formula One ex-champion Michael Schumacher has had.

The injuries resulting from the deceleration are, as already mentioned, the most serious. Among these, concussion and diffuse axonal injury (DAI) are the most dangerous the latter being responsible for most deaths and severe sequelae.

Concussion is a change in consciousness with recovery in minutes and no clinical or structural sequelae resulting from non-penetrating traumatic injury. It occurs at low speed and torque, around 7.5 m/s (27 km/h), mainly in contact sports (American Football, Rugby, Boxing, etc.).

Diffuse Axonal Injury (DAI) is a potentially fatal injury associated with torque and leaves severe sequelae in case of survival. It occurs almost as an extension of the concussion except for the fact that the forces and velocities involved are larger. The average speed in the motorcycle accident is 44 km/h and the angle of impact is 28 degrees. Under these conditions, a deceleration injury becomes almost inevitable.

By inertia, the brain tissue undergoes compression, torsion and mechanical shear with structural rupture and cell death.

FIG. 1 shows in a simplified way that, upon applying an angular acceleration φ (torque), the contents of a vessel are subjected to shear stresses, as exemplified in the lower right part of the figure. This is the mechanism of diffuse axonal injury, that is, diffuse injury of the whole brain, when the impacted in speed with rotation of the head.

This set of structural changes causes brain swelling with increased intracranial pressure and encephalic death due to the impossibility of maintaining cerebral blood flow.

In the medical literature, several researchers have already detected the problem. Parreira says:

"Neurological lesions are the most frequent cause of death in traumatized motorcyclists. However, we noticed that the incidence of severe lesions in the cephalic segment in our sample was lower in motorcyclists when compared to other mechanisms of trauma. Among the injuries investigated, motorcyclists exhibited a lower frequency of extradural hematomas, subdural hematomas, subarachnoid hemorrhages and cerebral contusions, but more frequently presented diffuse axonal lesion. This may indicate a certain protection of the helmet against injuries that occur by blow and counterblow, but not against lesions related to abrupt speed and shear reduction (our emphasis) in Parreira, J. G. et al—"Comparative analysis between lesions found in motorcyclists involved in traffic accidents and victims of other closed trauma mechanisms"—Rev Assoc Med Bras 2012; 58(1): 76-81).

Martinus Richter states in an excellent study in 2001:

"The lesions caused by indirect force effect (e.g., acceleration and deceleration) remain a problem. In particular, rotation is an important and underestimated factor. The reduction of the kinetic consequences of the effecting forces should be a direction for future motorcycle helmet generations" in Richter M, Otte D, Lehmann U, Chinn B, Schuller E, Doyle D: *Head injury mechanisms in helmet protected motorcyclists: prospective multicenter study. J Trauma* 2001, 51:959-958.

Although the global scientific literature has long been concerned with the problem, it has simply been ignored by industry.

Indeed, over the years, the helmet industry has been focused on meeting the certification standards rather than the evolution of neurotraumatology knowledge. All modifications have been focused on the shell, increasing its "resistance" to impact to the detriment of the absorption of impact energy. The result was that, as the shell became stiffer, the absorptive layer became less dense and thicker, increasing the dimensions and weight of the helmets, some even weighing 1.8 kg!

The increase in the dimensions of the helmet does not solve the problem of the prevention of diffuse axonal lesion, and may even be aggravating or even inducing such lesion, because the larger the helmet, the greater the torque over the head, since the applied force is directly proportional to the distance from the center of rotation to the point of impact of the force applied to the shell. The aforementioned work by Parreira is indicative thereof.

FIGS. 2-*a* and 2-*b* exemplify what happens when the thickness of the impact absorber layer is increased. This example shows a helmet comprising a rigid outer shell 11, in which a layer of absorbent material 12 rests on the head of the user 13. A tangential impact at point 15 gives rise to a force 16 at that point. This impact produces a second force 17 applied to the cranium whose value depends on the distance d1 between the point of application of the impact and the center of rotation of the set.

As shown by FIG. 2-B, the increase in the thickness of the absorbent material layer 12' results in an increase in the distance d2 between the impact point 15' and the center of rotation 14. As a consequence, the torque 17' applied to the cranium is larger than in the previous case, resulting in an increase in shear stresses and, therefore, in the possibility of injury by DAI.

We are convinced that traditional helmets can generate angular accelerations within the skull superior to the Gennarelli limit of 12,000 rads/s$^2$, above which, depending on the impact speed, there is a 100% probability of DAI. The aforementioned work by Parreira supports this belief. The structured CPC according to the present invention may, according to our estimates, achieve angular acceleration values lower than the median of the Gennareli curve, which performance is still subject to further improvements.

The graph of FIG. 5 shows that, for this angular acceleration value, only concussion occurs, the recovery of which occurs in minutes and without clinical or structural sequelae.

In addition to the increased torque applied to the user's head, a larger helmet, such as that shown in FIG. 3, increases aerodynamic drag and has greater mass, requiring greater effort of the user's muscles and increasing the load on the cervical spine.

A second aspect of the current helmets refers to the chin guard region. For example, the helmet of the prior art shown in FIG. 3, reproduced from patent U.S. 62/126,898, is provided with a thick layer of absorbent material 10 in the region of the cranium, although its chin guard is completely devoid of absorbent material. Hence, in the case of frontal impact, the chin and the jaw are subjected to the full force of the impact, which is transmitted integrally to the base of the skull and can cause its fracture.

One additional aspect in which the precariousness of the helmets produced according to the known art relates to the absorptive layer. The main function of the material used in this layer is to increase the impact time. The physical justification establishes that the acceleration is the result of the impact velocity divided by the time when this velocity falls to zero, where:

$a=(Vi-Vo)/t$ where $a$ is the acceleration

Vi is the initial velocity, e.g., the one in which the impact occurs.

Vo is the final velocity, which in the present case is zero.

t is the time spent in the reduction of Vi to zero.

Thus, it follows that the smaller the impact time the greater will be the acceleration to which the head is subjected and, consequently, the force acting on it, according to the expression:

$$F=m\cdot a$$

so that

F=(m·Vi)/t where m is the mass of the user's head.

When the helmet strikes an obstacle, the head compresses this layer, which has a resistance to deformation.

Practically all helmets sold in large scale worldwide have expanded polystyrene (EPS), or "styrofoam", as it is known in Brazil, as an absorptive layer. Despite its widespread use, this material presents several disadvantages, such as shear and fragmentation, which compromises its function. In addition, its compressive strength is not uniform, but increases with deformation. As a result, the effective deformation time is reduced, consequently increasing the acceleration and the force acting on the head.

An attempt to improve the performance of the helmets is described in U.S. Pat. No. 7,802,320 entitled Helmet Padding, whose FIG. 1 is reproduced in the present application as FIG. 4. As shown in this document, two layers of absorbent material, a low-density inner layer next to the skull and another high-density outer layer are used. The inner layer is provided with a plurality of conical protrusions that fit into complementary recesses in the outer layer.

This is a simple padding modification of a known type, which uses expanded polystyrene (EPS) foam, or styrofoam, in two layers with different densities, differing from the prior art only by the provision of said protrusions and complementary recesses. However, the use of such material does not provide any reduction in the size and/or weight of the helmet, resulting in a situation as shown in FIG. 2-*b*, in addition to not producing any gain of aerodynamic efficiency.

The document does not disclose the existence of any technical effect different from those already known which could arise from the use of the structure in two layers of styrofoam with different densities comprising conical protrusions and recesses. Furthermore, as previously pointed out, such material fragments easily, especially when subjected to shear stresses occurring in the case of tangential forces, as exemplified in FIGS. 2-*a* and 2-*b*.

Hence, not only is the subject matter of U.S. Pat. No. 7,802,320 totally inadequate for the prevention of Diffuse Axonal Injury, but it also shows a non-uniform resistance to compression, which, in the case of radial impacts, reduces the effective deformation time and, consequently, increases the acceleration acting on the head, as also previously discussed.

OBJECTS OF THE INVENTION

Considering what has been laid down, it is a first object of the invention to provide impact absorbing means which minimize the transmission of tangential stresses (torque) on the user's head.

Another object is the provision of impact absorbing means which increases the deformation time.

One more object is to reduce the thickness of the absorptive material to reduce the size of so-called helmets and their mass.

One more object is to increase protection to the region of the user's face, especially jaws and chin.

One more object is to bring the visor closer to the face by increasing the user's field of vision.

One more object is to hold the helmet longer on the head in the event of an impact, since in 38% of the time a known helmet breaks out because it is only held by the jugular strap.

SUMMARY OF THE INVENTION

The foregoing as well as other objects are attained by the invention by a cranial protection cell (CPC) provided with impact absorbing means comprising first and second foam layers having different properties from each other, the inner layer closest to the user's head being of low resilient viscoelastic material and provided with protrusions which deform elastically under mechanical stress, and the outer layer, located next to the shell, being of rigid or semi-rigid material, provided with a plurality of cavities into which the above mentioned protrusions complementary and cooperating fit together, wherein said outer layer comprises a material having a lower density than said inner layer material.

According to another feature of the invention, the embossed elements of said inner layer comprise protrusions that fit into the bas-relief elements of said outer layer.

According to another feature of the invention, said outer layer, located immediately next to the shell, comprises a rigid foam with closed cells.

According to another feature of the invention, said inner layer, located between said outer layer and the user's head, comprises a viscoelastic foam, being separated from the users head by a coating fabric.

According to another feature of the invention, the cranial protection cell comprises a chin guard provided with impact absorbing material.

According to another feature of the invention, said impact absorbing material comprises a double foam layer, identical to the one that covers the cranium. Said double layer is supported in the maxillary regions of the face, where there is greater capacity of absorption of impact and also surrounds the chin producing another point of retention of the helmet in the head besides the jugular strap.

According to another feature of the invention, the temporal regions of the cranial protection cell are also provided with the same impact absorbing material pads used in the chin guard.

According to another feature of the invention, the cranial protection cell comprises a visor which, when closed, is embedded in a corresponding aperture of the cranial protection cell's frontal region, thus preventing its accidental opening due to wind intensity.

According to another feature of the invention, the opening of the visor is performed in two phases, the first comprising translational forward movement and the second a rotational movement around a pin-shaped axis.

According to another feature of the invention, the angle of inclination of the visor relative to the vertical is zero, approaching the pantoscopic angle, widening the field of vision and allowing data projection therein. Furthermore, the smaller distance between the visor and the user's face, due to the decrease in the thickness of the foam layers used in the invention, improves the user's field of vision.

According to another feature of the invention, the chin guard moves in 2 forward stages and can be totally withdrawn, turning the cranial protection cell into an open helmet for activities such as skiing and cycling. The first stage is for the placement and removal of the helmet, since when in position zero, it surrounds the mental region (chin) preventing the loss of the helmet in the impact because it is an additional retention point; the second stage is activated for the complete removal of the chin guard.

According to another feature of the invention, the shell has a mechanical behavior that contributes to the dissipation of energy and, at the same time, does not have external protrusions that can cause friction and locking of rotation in case of fall.

According to another feature of the invention, the shell, instead of the commonly used composite materials, is produced in reaction injection molded (RIM) thermoplastic aiming to a mechanical resistance behavior up to a certain limit followed by breaking the shell, fracturing it and dissipating energy.

DESCRIPTION OF THE DRAWINGS

Further features and advantages of the invention will be evident from the description of a preferred, and non-limiting, embodiment, given as an example, and from the figures it refers to, wherein:

FIG. 1 illustrates, in a simplified way, the shear effect resulting from the application of rotational stress.

FIGS. 2-*a* and 2-*b* illustrate the increase of the torque applied to the user's head when increasing the thickness of the absorbent material layer.

FIG. 5 is a graph illustrating the relationship between angular acceleration and Diffuse Axonal Injury (DAI), developed by Gennarelli, T. A. in *Head Injuries: How to Protect What*, Snell Conference on HIC, May 6, 2005, Milwaukee, Wis., USA.

FIG. 6-*a* is a schematic perspective view showing the relationship between the layers of impact absorbing material used in the invention.

FIGS. 6-*b* and 6-*c* outline the deformation at the interface between the stiffer outer layer and the inner viscoelastic layer upon application of a tangential stress.

FIGS. 9*a*-9*e* show in detail the sequence of steps having to do with the handling of the visor and depicting its opening.

FIGS. 10-*a*, 10-*b* and 10-*c* refer to details of the removable chin guard and its retention mechanism, according to the invention.

DETAILED DESCRIPTION OF THE INVENTION

Figure 3:
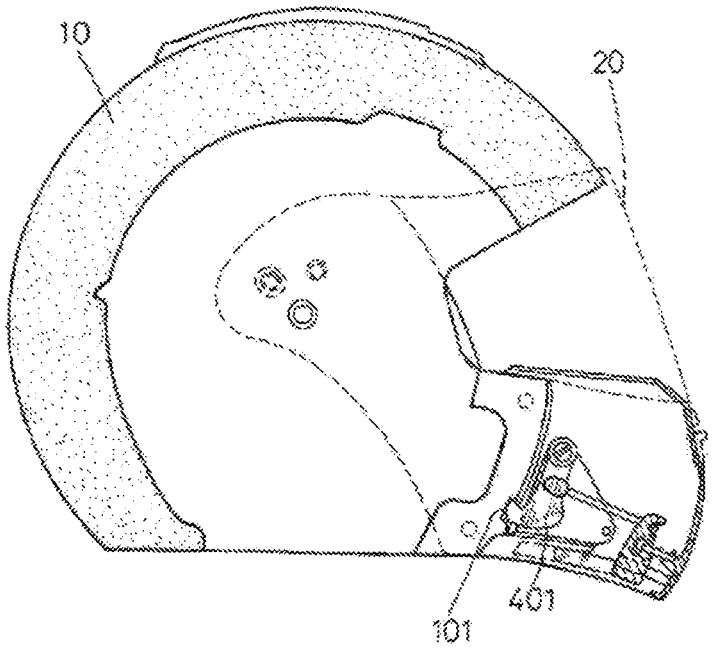
FIG. 3 shows a state-of-the-art helmet fitted with a single layer absorbent material.
Figure 4:
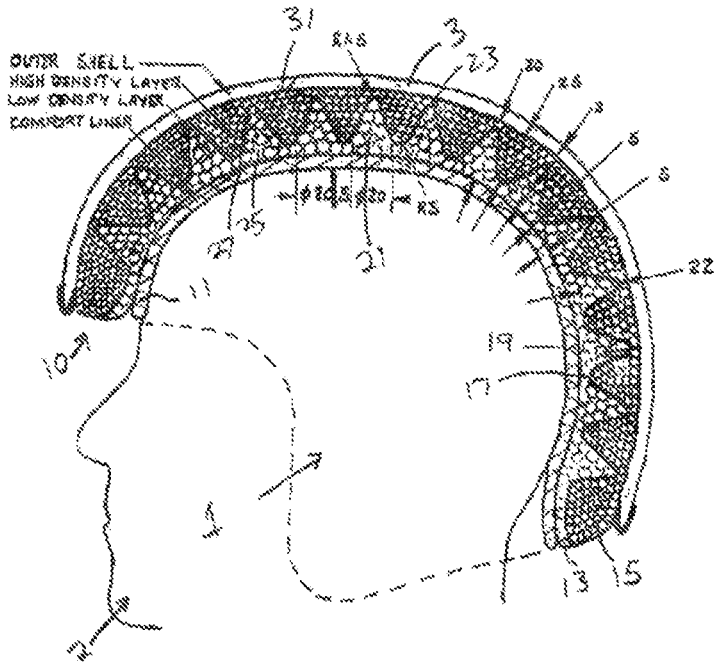
FIG. 4 illustrates another state-of-the-art helmet provided with two layers of expanded polystyrene foam (EPS) which differ only in that they have different densities.

Referring now to FIG. 6-A, the absorbent means used in the invention comprise a first layer (21) of rigid or semi-rigid polyurethane foam of closed cells having a thickness of between 18 mm and 28 mm, a thickness of approximately 23 mm being preferably used. The density of this material varies between 40 and 85 kg/m$^3$, preferably adopting an approximate value of 45 kg/m$^3$ and its mechanical resistance to compression varies between 120 kPa and 200 kPa. The number of cells per cm$^3$ and mechanical strength may vary. The invention is not restricted to the cited material, and equivalent materials with similar characteristics of density and mechanical behavior may be used.

When an impact occurs, the user's head, compressing this layer, causes the collapse of the cells with consequent absorption of energy and increase of the time of impact, with permanent deformation, unlike the EPS, a fundamental function to prevent traumatic brain injury.

FIG. 6-A further shows the second layer 22, located between said first layer and the user's head. It is a viscoelastic foam with properties of high impact absorption (up to 90%), sound and vibrations, and due to the soft touch, it reduces points of tension in the user's skin. Its function is to provide comfort and, at the moment of impact, to distribute the pressure that the head will make on the rigid layer and to be the first, and perhaps the most important, impact energy absorption element. It has a role similar to that of the cerebrospinal fluid in the central nervous system.

This second layer consists of an open cell foam, with a density between 50 and 95 kg/m$^3$, preferably adopting the value of 65 kg/m$^3$. The material's indentation strength at 40% is between 80N and 150N. The thickness of this layer varies between 12 mm and 22 mm, with a preferential value of approximately 17 mm. Like the previous one, its configuration can vary taking into consideration several parameters, being able to be replaced, as before, by another material, provided that it has similar mechanical performance.

As shown by FIG. 6-A, said layers interdigitate so that the assembly has a final thickness of not more than 35 mm, preferably 30 mm, and not 40 mm as would be expected from the sum of its thicknesses. New materials, provided that with similar mechanical behavior as defined herein, may even result in the future decrease of this thickness.

Still according to FIG. 6-*a*, the surfaces at the interface between said layers have indented fittings, i.e. embossed configurations. In this figure, as well as in the sectional view of FIG. 6-*b*, a plurality of cavities 24 are provided in the first layer 21, a plurality of protrusions 23 corresponding thereto are provided in the second layer 22, said protrusions being positioned coincidently with said cavities, in which they fit cooperatively and complementarily. This figure further shows a comfort fabric 26 between the second layer 22 and the user's head 25, and the shell 20 to which the double layer of impact absorbing material is attached.

The indented fitting of the foams allows an increase in the impact-absorbing surface, an increase in the deformation time and, more importantly, allows a partial longitudinal displacement between them to minimize torque on the brain. Such displacement is shown in cross-sectional views 6-*b* and 6-*c*.

As shown in FIG. 6-C, part of the tangential forces acting on the shell 20 are dissipated by the deformation of the protrusions 23, thus there is only partial transmission of the forces to the motorcyclist's head (which is symbolized by the length of the arrows). Also, in a radial impact the head begins to compress the viscoelastic layer and then the semi-rigid layer, the first deformation of which is done sidewards (into the cavities) and only then for the longitudinal direction. This increases the impact time by decreasing the force, as demonstrated previously.

Figure 7:
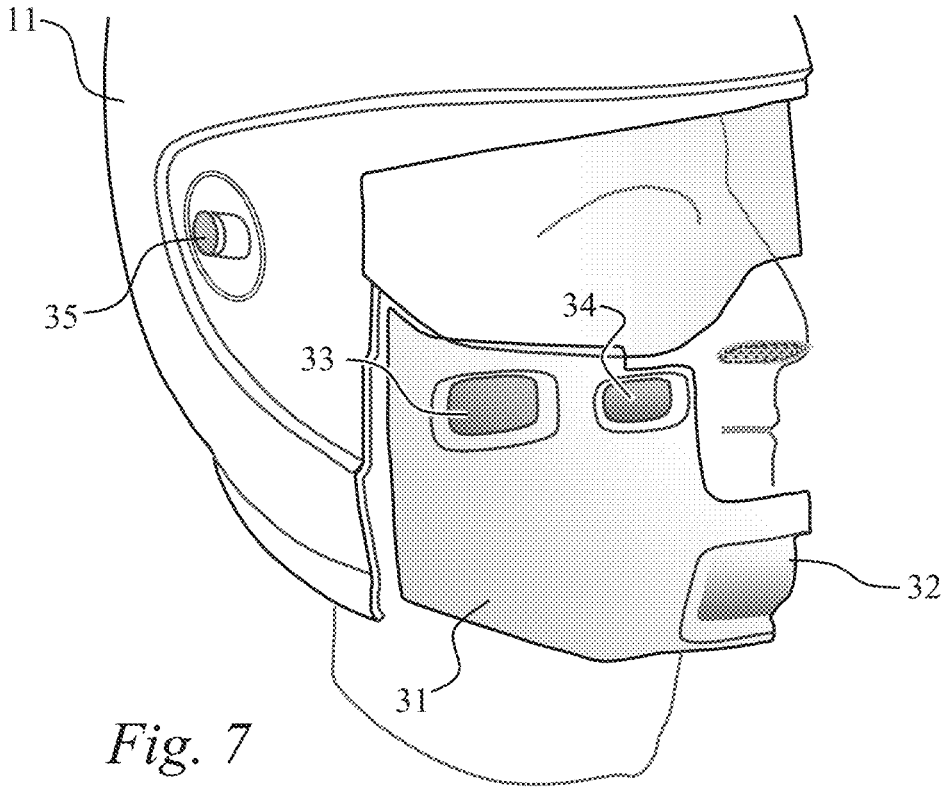
FIG. 7 shows, in detail, the provision of the absorptive material pads in the chin guard and in the maxillary region.

FIG. 7 is an illustrative view of the absorbent material supporting pads 32 in the chin guard 31, which surrounds the mental region creating an additional attachment point. In addition to this material, the supports 33 and 34 of the absorptive material are provided in the maxillary regions, allowing greater protection of the user in case of frontal impact.

FIG. 7 further shows one of the external drive buttons 35 of the visor lock, as will be described in connection with FIG. 9.

Figure 8:
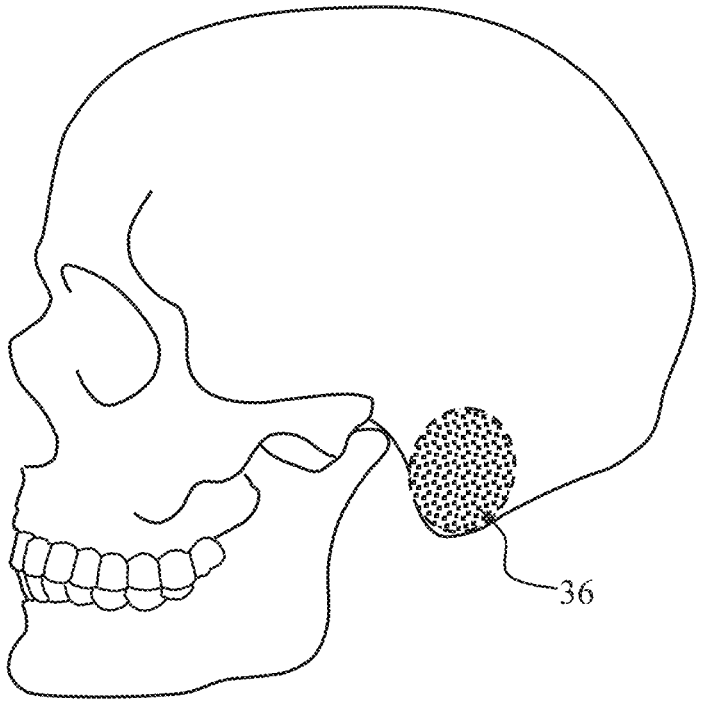
FIG. 8 shows, in detail, the provision of the absorptive material pads in the mastoid regions.

As shown in FIG. 8, the invention further provides absorptive material support pads 36 in the mastoid regions, thereby creating a third retention point, in addition to the mental region and jugular strap.

The set of FIGS. 9-*a* . . . 9-*e* refers to the handling of the visor of the cranial protection cell (CPC) of the invention. FIG. 9-*a* is a cross-sectional internal view of the cranial protection cell showing the elements forming part of the visor subassembly mechanism, as will be described below.

FIG. 9-*b* is a partial external view of the CPC showing one of the drive buttons 35 of the visor subassembly, located on the side of the shell, there being a similar, symmetrically disposed button on the opposite side of the shell.

According to the detailed internal view of FIG. 9-*c*, said button is internally associated with a pin-shaped axis 40 around which the visor subassembly rotates when it is lifted during the opening procedure. As shown, the visor 37 is rigidly attached to the distal end 38*a* of a rod 38 whose proximal end is integral with said pin-shaped axis.

According to the invention, there is provided a substantially horizontal through slit 39 on each side of the shell, which is provided at both ends with enlargements, i.e., flares into which said pin-shaped axis fits. In the normally closed position, shown in FIG. 9-*c*, the pin-shaped axis 40 fits into the first flare 39*a*. As can be seen, in this position the lower edge of the visor is recessed relative to the front face 41 of the shell, which prevents its accidental opening by the wind pressure when at high speeds.

To open the visor, the buttons 35 disengage each of the pin-shaped axis 40 from said first flare, allowing the subassembly—comprising pin-shaped axes 40, rods 38 and visor 37—to be pushed horizontally forward to the position shown in FIG. 9-*d*, where pin-shaped axes 40' fit into the second—forward—flare 39*b* of each of said through slits 39. As shown in the figure, the visor is now in an advanced position relative to the front of the shell.

To complete the opening procedure, the rods 38 rotate about the fulcrums that correspond to pin-shaped axes 40', as indicated in FIG. 9-E, this rotation being limited by the contact of restraining means 38*a* at the distal ends of the rods 38' with the upper edge 42 of the shell aperture 55.

FIGS. 10-*a*, 10-*b* and 10-*c* refer to a CPC chin guard. FIG. 10-*a* illustrates a side view of the CPC with the chin guard in its normal position. This figure shows one of the buttons 51 which drive the chin guard unlocking mechanism, wherein another identical button is provided on the opposite side of the shell.

FIG. 10-*b* is a detailed view corresponding to the B-B cross-section of the previous view. The detail shows the button 51, the swing lock 52 provided with a retainer claw (not referenced), the toothed retaining element 53, that is attached to the groove 54 and the main shell 11 of the CPC.

As shown in FIG. 10-*b*, the button 51 is coupled to the first end of the swing lock 52 by means of a shaft (not referenced). Hence, when the button 51 is pressed the lock will oscillate through a "seesaw" effect, unlocking the retainer claw at the second end of the teeth of the retaining member 53, the withdrawal of the chin guard 54 being then released by simple forward sliding, as shown in FIG. 10-*c*.

In brief, the cranial protection cell (CPC) of the present invention stands out from the conventional helmets for a number of advantages, among which the following stand out:

face protective structure, protecting against frontal impacts;

reduction of the risk of Torque and Diffuse Axonal Injury reduced weight, around 1 kg, with more comfort and less aerodynamic drag;

visor fitting system, increased optical efficiency and removable chin guard;

absorptive material in the mastoid regions;

better CPC retention in the user's head;

smooth shell without protrusions, avoiding the head locking against some external obstacle, which contributes to reduce or prevent torque.

Thus, the Cranial Protection Cell of the invention embodies a radically innovative concept when compared to known helmets, overcoming the previous technique from a functional point of view, extending in a significant and scientific way the protection of the skull and, consequently, of the brain.

The invention claimed is:

1. A cranial protection cell for receiving a user's head comprising:

(a) an outer rigid shell;

(b) a double layer of impact absorbing material coating the inside of said rigid outer shell, comprising a first outer layer located next to said shell and a second innermost layer located next to the first outer layer, the first outer layer be disposed between the outer rigid shell and the second innermost layer;

(c) said first outer layer being provided with a plurality of cavities;

(d) said second innermost layer formed of a viscoelastic material and is provided with a plurality of viscoelastic protrusions that fit into the plurality of cavities provided in said first outer layer, said protrusions being elastically deformable under mechanical stress;

(e) said first outer layer having greater rigidity and lower density than said second innermost layer and greater thickness than said second innermost layer;

(f) a visor, and wherein said outer rigid shell includes a front aperture, the visor being embedded in a front aperture of said shell when closed; and (g) at least one right side supporting rod, and at least one left side supporting rod, wherein each of said at least one right side supporting rod and said at least one left side supporting rod includes a proximal end and a distal end, said visor having a right side and a left side attached respectively to said distal ends of said at least one right side supporting rod and said at least one left side supporting rod, respectively, each said proximal end including an integral pin-shaped axis, wherein said shell includes a through slit on each of said right side and said left side of the shell, each said through slit having a rear end including a first flare and a front end including a second flare, respectively, whereby said pin-shaped axes are received as a non-permanent fitting.

2. The cranial protection cell according to claim 1, wherein said first outer layer is comprised of closed cell polyurethane foam with a density between 40 and 85 kg/m$^3$ and a mechanical compression strength between 120 kPa and 200 kPa.

3. The cranial protection cell according to claim 1, wherein said second innermost layer consists of open cell viscoelastic foam, with a density between 50 and 95 kg/m$^3$ and indenting force (40%) between 80N and 150N.

4. The cranial protection cell according to claim 1 including a chin area configured to be disposed proximal to a jaw of the head of the user, wherein the impact absorbent material comprises supporting pads in the chin area, adapted to be at a front part of the jaw, the support pads including a double layer of impact absorbing material.

5. The cranial protection cell according to claim 1, further comprising impact absorbent material supporting pads positioned within the rigid shell such that the impact absorbent material supporting pads are adapted to be disposed at face maxillary regions of the user's head when the cranial protection cell receives the user's head, the impact absorbent material supporting pads including a double layer of impact absorbing material.

6. The cranial protection cell according to claim 1, further comprising impact absorbent material supporting pads positioned within the rigid shell such that the impact absorbent material supporting pads are adapted to be disposed at mastoid regions of the user's head when the cranial protection cell receives the user's head, the impact absorbent material supporting pads including a double layer of impact absorbing material.

7. The cranial protection cell according to claim 1, further including a right side external drive button located on a right side of the shell, a left side external drive button located on a left side of the shell, wherein the pin-shaped axis included in the proximal end of the at least one right side supporting rod is associated with said right side external drive button and the pin-shaped axis included in the proximal end of the at least one left side supporting rod is associated with said left side external drive button.

8. The cranial protection cell according to claim 1, wherein the opening of the visor is performed in two steps, the first step comprising disengagement of the visor from the front aperture through a forward translational movement, by means of the forward movement of said pin-shaped axis from said first flare towards said second flare of said through slit, the second step of opening of the visor comprising the upward rotation of the support rod about said pin-shaped axis after said pin-shaped axis is fitted into said second flare.

9. The cranial protection cell according to claim 1, further comprising a removable chin guard and respective locking mechanisms located on either side of the outer rigid shell.

10. The cranial protection cell according to claim 9, further comprising a retaining member attached to the chin guard, the retaining member including teeth, and wherein each locking mechanism comprises an outer drive button and a swing lock, the swing lock including first and second ends, the outer drive button being coupled to the first end of the swing lock, the second end of the swing lock including a retainer claw fitted into the teeth of the retaining member attached to the chin guard.

11. A cranial protection cell for receiving a user's head comprising:

(a) an outer rigid shell;

(b) a double layer of impact absorbing material coating the inside of said rigid outer shell, comprising a first outer layer located next to said shell and a second innermost layer located next to the first outer layer, the first outer layer be disposed between the outer rigid shell and the second innermost layer;

(c) said first outer layer being provided with a plurality of cavities;

(d) said second innermost layer formed of a viscoelastic material and is provided with a plurality of viscoelastic protrusions that fit into the plurality of cavities provided in said first outer layer, said protrusions being elastically deformable under mechanical stress;

(e) said first outer layer having greater rigidity and lower density than said second innermost layer and greater thickness than said second innermost layer;

(f) a removable chin guard and respective locking mechanisms located on either side of the outer rigid shell;

(g) a retaining member attached to the chin guard, the retaining member including teeth, and wherein each locking mechanism comprises an outer drive button and a swing lock, the swing lock including first and second ends, the outer drive button being coupled to the first end of the swing lock, the second end of the swing lock including a retainer claw fitted into the teeth of the retaining member attached to the chin guard.

* * * * *